US006791308B2

(12) United States Patent
Shim

(10) Patent No.: US 6,791,308 B2
(45) Date of Patent: Sep. 14, 2004

(54) INTERNAL POWER SUPPLY FOR AN INTEGRATED CIRCUIT HAVING A TEMPERATURE COMPENSATED REFERENCE VOLTAGE GENERATOR

(75) Inventor: Jae-yoon Shim, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/179,202

(22) Filed: Jun. 26, 2002

(65) Prior Publication Data

US 2003/0011351 A1 Jan. 16, 2003

(30) Foreign Application Priority Data

Jul. 4, 2001 (KR) ..... 2001-39760

(51) Int. Cl.[7] ..... G05F 3/16; G05F 3/20

(52) U.S. Cl. ..... 323/314; 323/316; 323/907

(58) Field of Search ..... 323/313, 314, 323/315, 316, 907

(56) References Cited

U.S. PATENT DOCUMENTS 5,307,003 A * 4/1994 Fairbanks et al. ..... 323/222
5,327,028 A * 7/1994 Yum et al. ..... 327/362
5,455,510 A * 10/1995 Nelson ..... 324/252
5,686,821 A * 11/1997 Brokaw ..... 323/273
5,798,637 A * 8/1998 Kim et al. ..... 323/313
6,211,661 B1 * 4/2001 Eckhardt ..... 323/316
6,232,832 B1 * 5/2001 Kirkpatrick, II ..... 327/560
6,300,818 B1 * 10/2001 Mao ..... 327/513
6,392,392 B1 * 5/2002 Nakahara ..... 323/312
6,489,836 B2 * 12/2002 Yeong ..... 327/541
6,507,233 B1 * 1/2003 Parfenchuck et al. ..... 327/513

* cited by examiner

*Primary Examiner*—Bao Q. Vu
(74) *Attorney, Agent, or Firm*—Lee & Sterba, P.C.

(57) ABSTRACT

The present invention provides a temperature-compensating reference voltage generator, including a temperature-compensating voltage divider, or variable voltage generator, for dividing an input reference voltage in order to generate a temperature-compensated output voltage. Preferably included, are a first differential amplifier for amplifying a voltage difference between a first reference voltage and a first feedback voltage in order to output an internal reference voltage, a first voltage divider for generating and outputting a first feedback voltage in response to the temperature-compensated voltage, the first voltage divider further including, two resistive elements for controlling a magnitude of reference voltage. In an embodiment of the present invention, operation of MOS transistors in a weak inversion region compensates for changes in temperature, thereby generating a temperature-independent voltage reference, and thus a temperature-independent power supply voltage, thereby reducing fluctuations in performance of semiconductor devices caused by variations in temperature.

21 Claims, 8 Drawing Sheets

INTERNAL POWER SUPPLY FOR AN INTEGRATED CIRCUIT HAVING A TEMPERATURE COMPENSATED REFERENCE VOLTAGE GENERATOR

BACKGROUND OF THE INVENTION

1. Field of the Invention

The present invention relates to semiconductor devices. More particularly, the present invention relates to an internal reference voltage generator and an internal power supply voltage generator in semiconductor devices.

2. Description of the Related Art

In conventional semiconductor devices, particularly, in semiconductor memory devices, in order to provide stable, low power operation, an internal power supply voltage is generated from an external power supply voltage and is used as a power supply source for each of the circuits on a chip. For semiconductor devices, the current in a transistor varies according to variations in temperature, and thus the performance of circuits having transistors fluctuates. For example, during a temperature increase, carrier mobility of a transistor decreases during strong inversion, thereby reducing the current and the operating speed of the circuitry.

In order to reduce such fluctuations in the performance of semiconductor devices caused by variations in temperature, a conventional internal power supply may include a feature wherein an output supply voltage is increased at a higher temperature, thereby increasing current through the chip transistors, and the output supply voltage is decreased at a lower temperature, with attendant decreased current. Thus, the current in a transistor may be maintained constant and independent of variations in temperature.

In one such approach, a band-gap reference generator has been used to vary an internal power supply voltage according to changes in temperature. FIG. 1 illustrates a conventional band-gap reference generator, wherein a reference voltage VREF is provided to a circuit for generating an internal power supply voltage. The band-gap reference generator shown in FIG. 1 is able to arbitrarily adjust and control a temperature coefficient of reference devices on a chip, and thus is able to vary the value of the reference voltage VREF as a function of temperature. Disadvantageously, a variation in the reference voltage VREF may be significantly larger than normal variations in an external power supply voltage EVDD.

In an alternate approach that does not use a reference voltage variation as discussed above, a complementary metal oxide semiconductor (CMOS) reference voltage generator is used instead of a band-gap reference generator to provide for stable voltage operation that is independent of changes in the external power supply. FIG. 2 illustrates such a conventional CMOS reference voltage generator. The CMOS reference voltage generator shown in FIG. 2 is insensitive to variations in the external power supply voltage EVDD and has a stable operation but disadvantageously cannot arbitrarily control the temperature dependency in the associated circuitry.

FIG. 3 illustrates a circuit diagram of a conventional internal power supply voltage generator. Referring to FIG. 3, the conventional internal power supply voltage generator includes an internal reference voltage generator 31 for receiving a reference voltage VREF and generating an internal reference voltage VREFP, a comparator 33 for comparing the internal reference voltage VREFP with an internal power supply voltage IVDD, and a driver 35 for receiving an external power supply voltage EVDD in order to generate and output the internal power supply voltage IVDD. The reference voltage VREF is a voltage that may be derived from the band-gap reference generator shown in FIG. 1 or the CMOS reference voltage generator shown in FIG. 2. The internal reference voltage generator 31 includes a differential amplifier 31*a*, a first resistor R1, and a second resistor R2. The internal reference voltage generator 31 generates the internal reference voltage VREFP according to the ratio of the resistors R1 and R2 and the reference voltage VREF. The internal reference voltage VREFP may be determined by the equation:

$$VREFP=VREF(1+R1/R2) \quad [1]$$

and is not sensitive to manufacturing processes and temperature.

Since the foregoing conventional internal power supply voltage generator is insensitive to temperature, the value of the internal reference voltage VREFP cannot be controlled by changes in temperature. As a result, the value of the internal power supply voltage IVDD also cannot be controlled by changes in temperature.

SUMMARY OF THE INVENTION

To solve the above problems, it is a first feature of an embodiment of the present invention to provide an internal reference voltage generator in a semiconductor device, which is capable of controlling the value of an internal reference voltage according to changes in temperature.

It a second feature of an embodiment of the present invention to provide an internal power supply voltage generator in a semiconductor device, which is capable of controlling the value of an internal power supply voltage according to changes in temperature.

It is a third feature of an embodiment of the present invention to provide a temperature-compensating reference voltage generator, including a temperature-compensating voltage divider for dividing an input reference voltage in order to generate a temperature-compensated output voltage at an output node of the voltage divider.

In order to implement the first feature, according to a first embodiment of the present invention, an internal reference voltage generator in a semiconductor device preferably includes a first differential amplifier for differentially amplifying a first reference voltage input into a first input terminal of the differential amplifier and an input voltage input into a second input terminal of the first differential amplifier in order to output an internal reference voltage to an output terminal of the first differential amplifier; a first resistor connected between the output terminal of the first differential amplifier and the second input terminal of the first differential amplifier; and a second resistor connected between a second reference voltage and the second input terminal of the first differential amplifier, the first and second resistors forming a first voltage divider. The impedance of the first resistor is preferably dynamically varied by a voltage that may be varied according to changes in temperature. Since variable impedance devices are typically implemented using active devices, it is preferable that the first resistor consists of one or more PMOS transistors, the gates of which are controlled by voltages that are varied according to the temperature.

In order to implement the first feature, according to a second embodiment of the present invention, an internal reference voltage generator in a semiconductor device preferably includes a first differential amplifier for differentially amplifying a first reference voltage input into a first input terminal of the first differential amplifier and an input voltage input into a second input terminal of the first differential amplifier in order to output an internal reference voltage to an output terminal of the first differential amplifier; a first resistor connected between the output terminal of the differential amplifier and the second input terminal of the first differential amplifier; and a second resistor connected between a second reference voltage and the second input terminal of the first differential amplifier, the first and second resistors forming a first voltage divider. The impedance of the second resistor is preferably dynamically varied by a voltage that is varied according to changes in temperature.

It is preferable that the second resistor consists of one or more NMOS transistors and that the voltages of gates of the NMOS transistors be varied according to the temperature. It is also preferable that the internal reference voltage generator further includes a temperature-compensating variable voltage generator for generating the reference voltage, which may be varied according to changes in temperature.

It is also preferable that the temperature-compensating variable voltage generator includes a second differential amplifier for differentially amplifying a third reference voltage input into a first input terminal of the second differential amplifier and a voltage input into a second input terminal of the second differential amplifier in order to output an output voltage to an output terminal of the second differential amplifier, a third resistor connected between the output terminal of the second differential amplifier and the second input terminal of the second differential amplifier, a fourth resistor connected between the second reference voltage and the second input terminal of the differential amplifier, and a variable voltage generator for generating the voltage varied according to changes in temperature in response to the output voltage of the differential amplifier and the third reference voltage. The third and fourth resistors form a second voltage divider.

In order to implement the second feature, according to a third embodiment of the present invention, an internal power supply voltage generator in a semiconductor device preferably includes an internal reference voltage generator for generating an internal reference voltage that may be varied according to changes in temperature; a comparator for comparing the internal reference voltage with an internal power supply voltage; and a driver for receiving an external power supply voltage in order to output the internal power supply voltage in response to an output signal of the comparator.

In order to implement the third feature, according to a fourth embodiment of the present invention, the temperature-compensating reference voltage generator having the temperature-compensating voltage divider is provided, wherein the temperature-compensating voltage divider preferably includes at least a first electronic element having a first output impedance that exhibits a positive temperature coefficient and at least a second electronic element having a second output impedance that exhibits a negative temperature coefficient, the first and second electronic elements being combined such that a change in the temperature-compensated output voltage is a function of a change in temperature. The first electronic element may be a PMOS transistor and the second electronic element may be an NMOS transistor, in which case the PMOS transistor should operate in a weak inversion region and the NMOS transistor should operate in a strong inversion region. In the fourth embodiment, the change in the temperature compensated output voltage is either directly or inversely proportional to a change in temperature.

Another feature of the present invention is implemented by a fifth embodiment of the present invention that provides a temperature compensating power supply, including: a temperature-compensated reference voltage, which is generated from at least two reference voltages and a regulating element for generating an output voltage from an input voltage under control of the temperature-compensated reference voltage and characterized in that the output voltage rises with increased temperature and falls with decreased temperature. Alternatively, in a sixth embodiment of the present invention, the output voltage falls with increased temperature and rises with decreased temperature.

Preferably, in the fifth and sixth embodiments, at least one of the two reference voltages is a temperature-compensated reference voltage. Preferably, the temperature-compensated reference voltage is generated using at least one transistor operating in a weak inversion region and at least one transistor operating in a strong inversion region. In some cases, the two reference voltages are about the same or the same.

These and other features of the present invention will be readily apparent to those of ordinary skill in the art upon review of the detailed description that follows.

BRIEF DESCRIPTION OF THE DRAWINGS

The above features and advantages of the present invention will become more apparent by describing in detail preferred embodiments thereof with reference to the attached drawings in which.

DETAILED DESCRIPTION OF THE INVENTION

Figure 1:
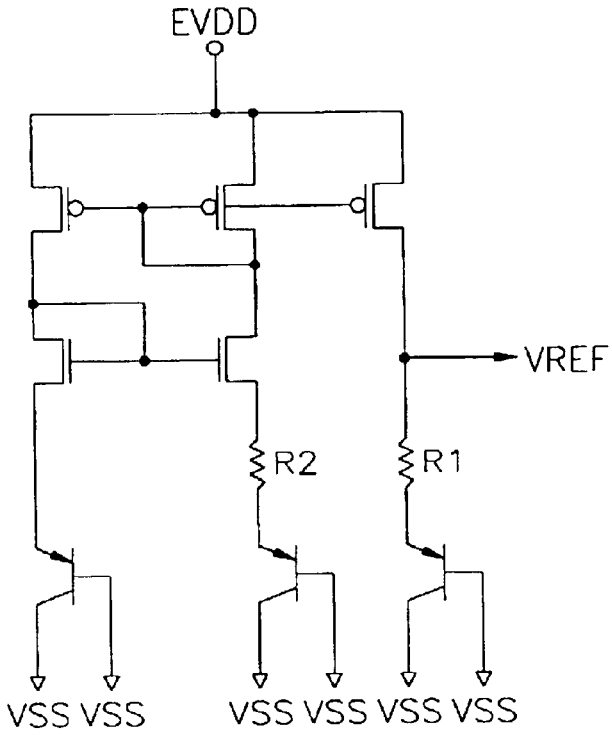
FIG. 1 (PRIOR ART)
FIG. 1 illustrates a circuit diagram of a conventional band-gap reference generator.
Figure 2:
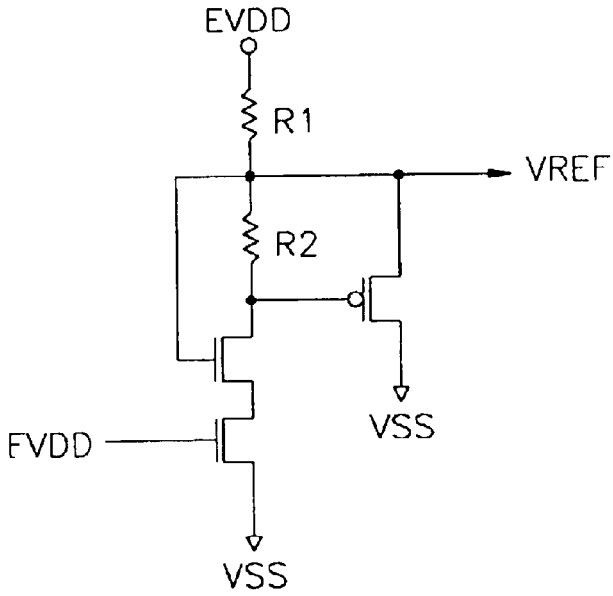
FIG. 2 (PRIOR ART)
FIG. 2 illustrates a circuit diagram of a conventional CMOS reference voltage generator.
Figure 3:
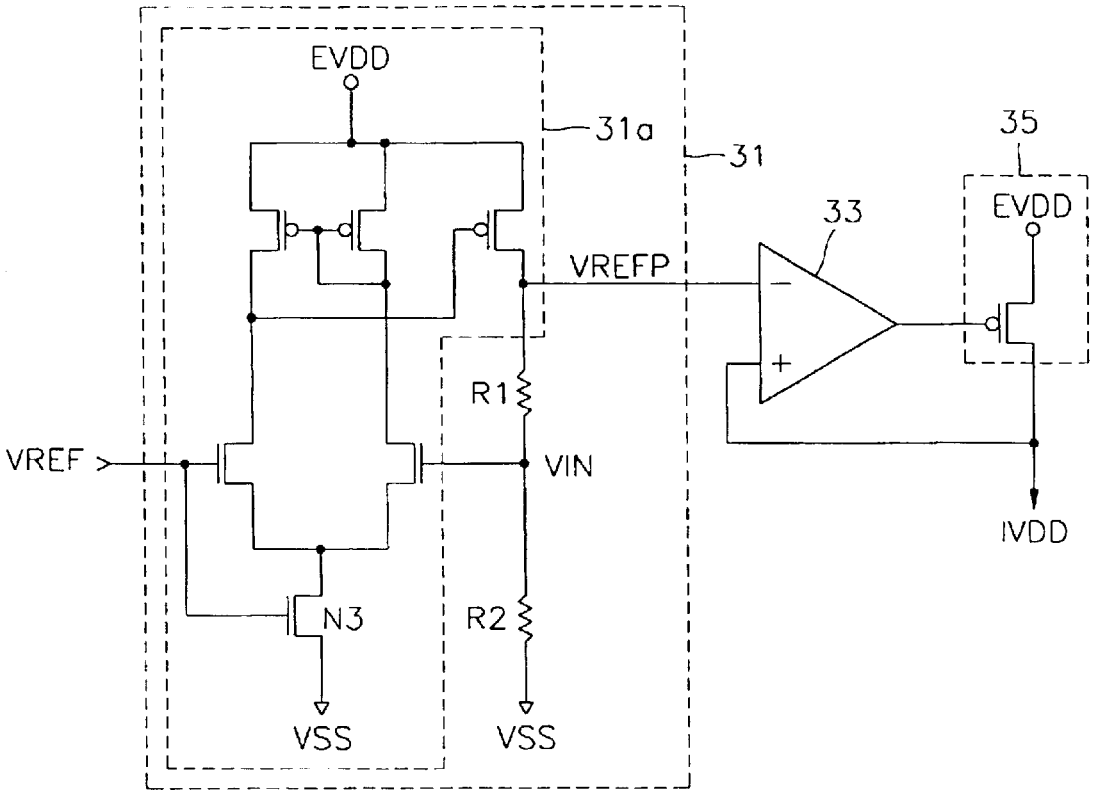
FIG. 3 (PRIOR ART)
FIG. 3 illustrates a circuit diagram of a conventional internal power supply voltage generator.

Korean Patent Application No. 01-39760, filed Jul. 4, 2001, and entitled: "Internal Reference Voltage Generator Capable of Controlling Value of Internal Reference Voltage According to Temperature Variation and Internal Power Supply Voltage Generator Including the Same," is incorporated by reference herein in its entirety.

The present invention will be described more fully hereinafter with reference to the accompanying drawings in which preferred embodiments of the invention are shown. Hereinafter, the present invention will be described in detail by describing preferred embodiments of the present invention with reference to the accompanying drawings. Like reference numerals refer to like elements throughout the drawings.

Figure 4:
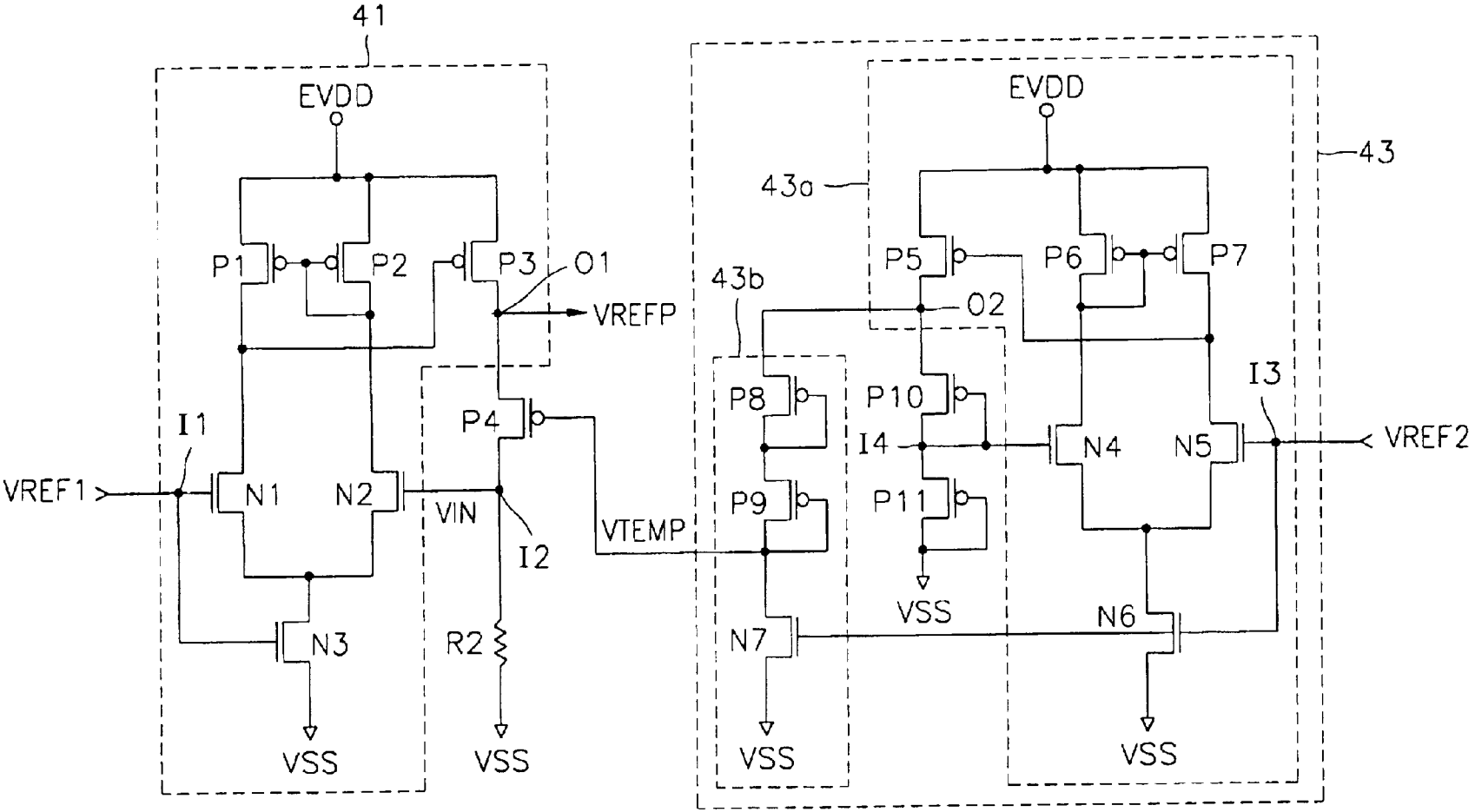
FIG. 4 illustrates a circuit diagram of an internal reference voltage generator according to a first embodiment of the present invention.

FIG. 4 illustrates an exemplary circuit diagram of an internal reference voltage generator according to a first embodiment of the present invention. Referring to FIG. 4, the internal reference voltage generator preferably includes a differential amplifier 41, a resistor R2, a PMOS transistor P4 serving as a resistor, and a temperature-dependent variable voltage generator 43, the combination of resistor R2 and PMOS transistor P4 forming a resistive voltage divider.

Differential amplifier 41 differentially amplifies a first reference voltage VREF1 input into a first input terminal I1 and an input voltage VIN input into a second input terminal I2 and outputs an internal reference voltage VREFP to an output terminal O1. Differential amplifier 41 is a conventional negative feedback type differential amplifier and may include PMOS transistors P1 through P3 and NMOS transistors N1 through N3. Resistor R2 is connected between a second reference voltage, that is, a ground voltage VSS, and the second input terminal I2 of differential amplifier 41. The PMOS transistor P4 is connected between the output terminal O1 of differential amplifier 41 and the second input terminal I2 of differential amplifier 41. A variable output voltage VTEMP of the temperature-dependent variable voltage generator 43 is applied to a gate of PMOS transistor P4.

The temperature-dependent variable voltage generator 43 receives a third reference voltage VREF2, generates the variable output voltage VTEMP, which varies according to changes in temperature, thus altering the equivalent resistance/impedance of the PMOS transistor P4. Third reference voltage VREF2 may be the same as or different from the first reference voltage VREF1. The temperature-dependent variable voltage generator 43 preferably includes a differential amplifier 43*a*, a PMOS transistor P10 serving as a resistor, a PMOS transistor P11 serving as another resistor, and a variable voltage generator 43*b*.

Differential amplifier 43*a* differentially amplifies the third reference voltage VREF2, which is input into a first input terminal I3, and a voltage input into a second input terminal I4 in order to output an output voltage to an output terminal O2. Differential amplifier 43*a* is a negative feedback type differential amplifier similar to differential amplifier 41 and may include PMOS transistors P5 through P7 and NMOS transistors N4 through N6.

PMOS transistor P10 serving as a resistor is connected between the output terminal O2 of differential amplifier 43*a* and the second input terminal I4 of differential amplifier 43*a*. The gate and drain of PMOS transistor P10 are both connected to the second input terminal I4. PMOS transistor P11 serving as a resistor is connected between a second reference voltage, that is, a ground voltage VSS, and the second input terminal I4 of differential amplifier 43*a*. A gate and drain of PMOS transistor P11 are connected to the ground voltage VSS.

If sizes and output impedances of PMOS transistor P10 and PMOS transistor P11 are equal, the voltage output to the output terminal O2 of the differential amplifier 43*a* is 2×VREF2. Since PMOS transistor P10 and PMOS transistor P11 are preferably matched and in a same environment, thereby having similar thermal properties, the impedance combination is thus insensitive to variations in manufacturing processes and temperature. An NMOS transistor pair or a resistor pair may be used in place of the PMOS transistors P10 and P11 with similar results.

Variable voltage generator 43*b* generates the variable output voltage VTEMP, which is varied according to changes in temperature. The changes in temperature are in response to the voltage output from output terminal O2 of differential amplifier 43*a* and third reference voltage VREF2. Variable voltage generator 43*b* preferably includes a PMOS transistor P8, a PMOS transistor P9, and an NMOS transistor N7.

A source of PMOS transistor P8 is connected to the output terminal O2 of the differential amplifier 43*a*, and a gate of PMOS transistor P8 is connected to a drain of PMOS transistor P8. A source of PMOS transistor P9 is connected to the drain of PMOS transistor P8, and a gate and drain of PMOS transistor P9 are both connected to a node to which the variable output voltage VTEMP is output. A drain of NMOS transistor N7 is connected to the VTEMP node, and third reference voltage VREF2 is applied to a gate of NMOS transistor N7, and the ground voltage VSS is applied to a source of NMOS transistor N7.

In particular, PMOS transistor P8 and PMOS transistor P9 are designed to operate in a weak inversion region. For this purpose, a ratio of W/L of PMOS transistors P8 and P9 is increased, and a ratio of W/L of NMOS transistor N7 is reduced, wherein W denotes a width of a gate of a transistor, and L denotes a length of the gate of a transistor. Alternatively, an NMOS transistor or a resistor may be used in place of the PMOS transistors P8 and P9.

Figure 5:
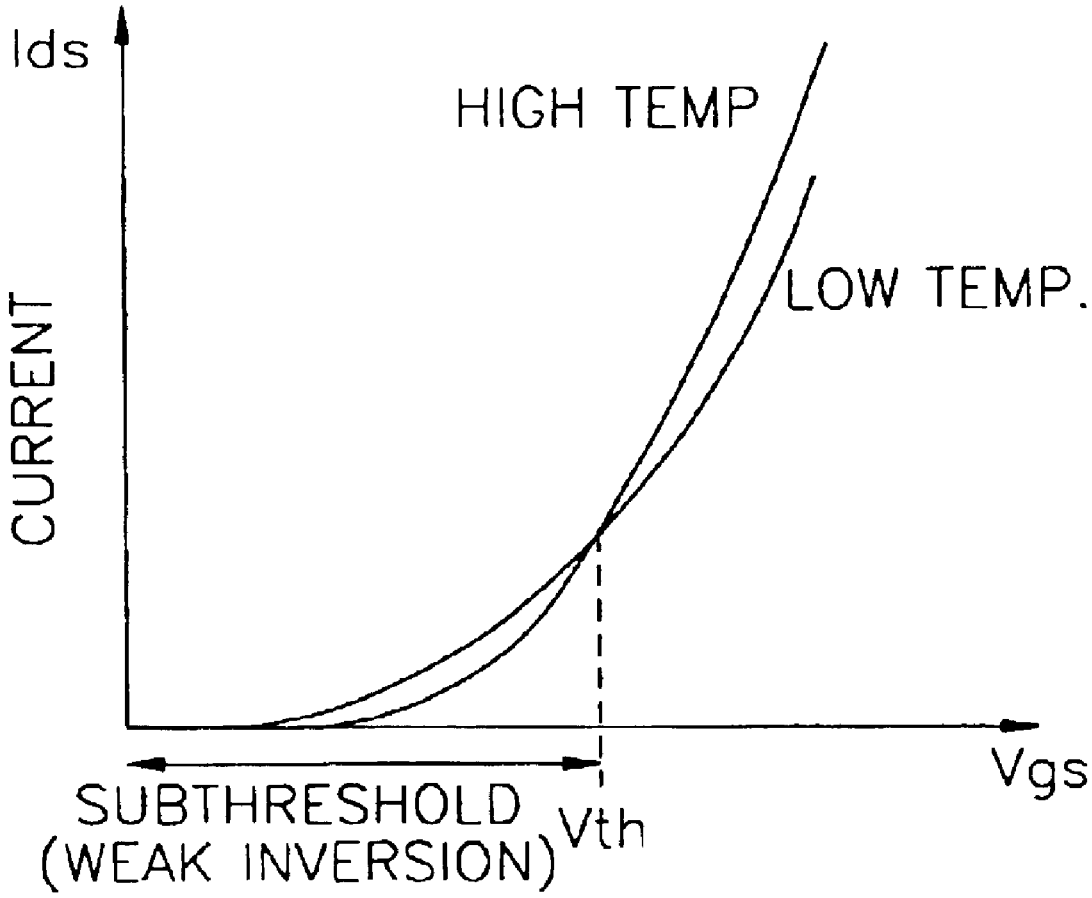
FIG. 5 illustrates a graph showing variations in current versus gate voltage and temperature in a conventional transistor.

FIG. 5 illustrates a graph showing variations in current versus gate voltage and temperature in a conventional transistor. Referring to FIG. 5, operation of the internal reference voltage generator according to the first embodiment of the present invention as shown in FIG. 4 will be described in greater detail.

Temperature related variations in a current Ids differ based on a threshold voltage Vth. In a case where a voltage Vgs (voltage between a gate and a source of a transistor) is smaller than the threshold voltage Vth, that is, in a weak inversion region, a turn-on voltage of the transistor becomes smaller as the temperature increases, and thus the current Ids becomes large. On the other hand, in a case where the voltage Vgs is greater than the threshold voltage Vth, that is, in a strong inversion region, carrier mobility decreases as the temperature increases, thereby decreasing the current Ids. The weak inversion region is also referred to as a subthreshold region.

Thus, in the internal reference voltage generator according to the first embodiment of the present invention as shown in FIG. 4, variations in the internal reference voltage VREFP corresponding to variations in the temperature are preferably implemented using weak inversion characteristics of the transistors. That is, as described above, PMOS transistors P8 and P9 of variable voltage generator 43*b* are preferably designed to operate in the weak inversion region, with the voltages Vgs of PMOS transistors P8 and P9 being varied according to temperature (i.e., the voltage Vgs is decreased at a higher temperature and increased at a lower temperature). This causes the variable output voltage VTEMP of variable voltage generator 43*b* to increase at a higher temperature and decrease at a lower temperature. As a result, the equivalent resistance of PMOS transistor P4, which receives the variable output voltage VTEMP through a gate thereof, is varied according to temperature.

Accordingly, as the temperature increases, the variable output voltage VTEMP of variable voltage generator 43*b* increases, the equivalent resistance of PMOS transistor P4 increases, and the internal reference voltage VREFP increases. On the other hand, as the temperature decreases, the variable output voltage VTEMP of the variable voltage generator 43*b* decreases, the equivalent resistance of PMOS transistor P4 decreases, and the internal reference voltage VREFP decreases.

Figure 6:
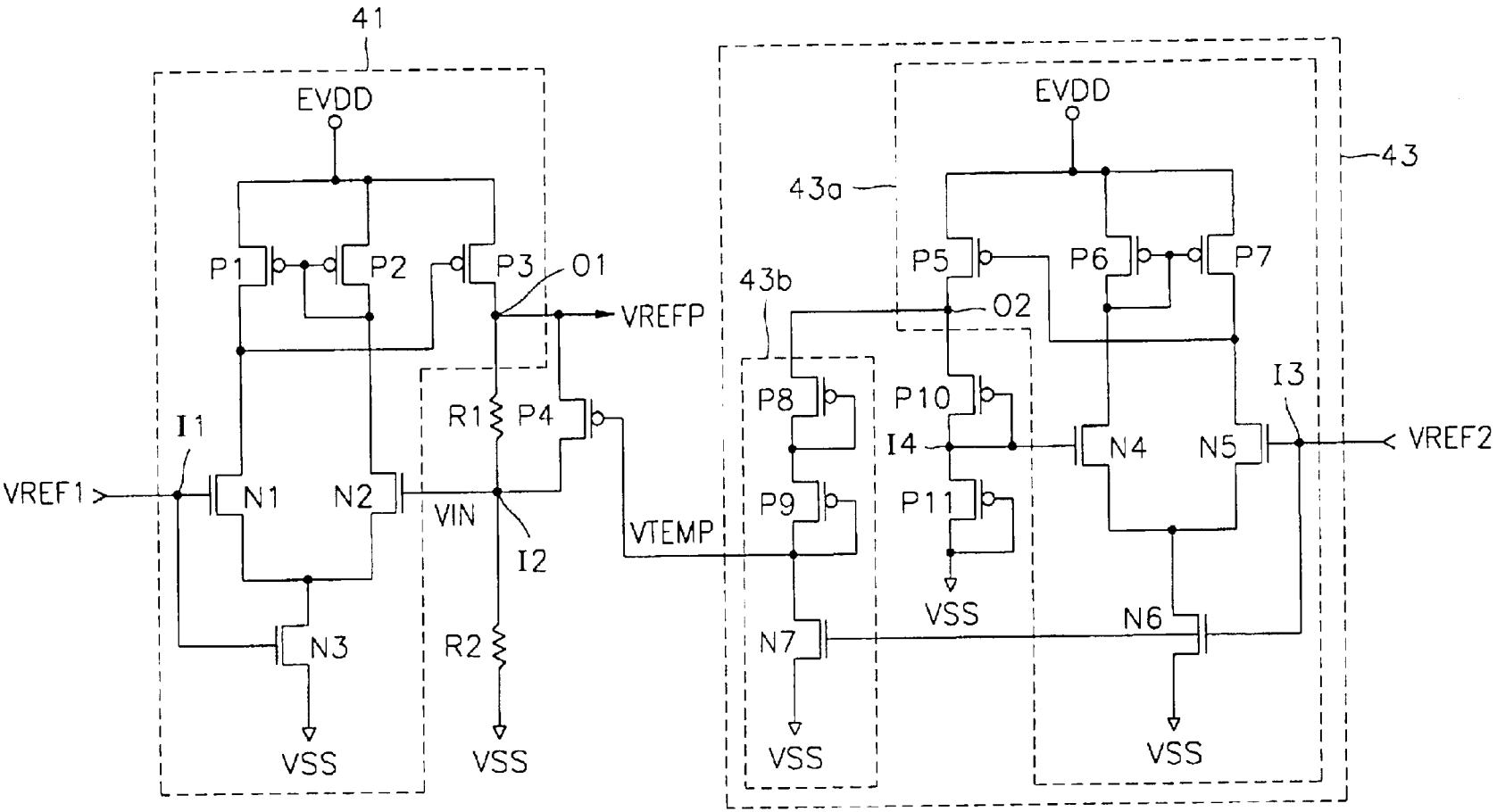
FIG. 6 illustrates a circuit diagram of an internal reference voltage generator according to a second embodiment of the present invention.

FIG. 6 illustrates an exemplary circuit diagram of an internal reference voltage generator according to a second embodiment of the present invention. Referring to FIG. 6, the internal reference voltage generator preferably includes a differential amplifier 41, a resistor R2, a PMOS transistor P4 serving as a resistor, and a temperature-dependent variable voltage generator 43. The internal reference voltage generator of the second embodiment of the present invention further includes a resistor R1, which is not present in the circuit of the first embodiment as shown in FIG. 4.

Differential amplifier 41, resistor R2, PMOS transistor P4, and temperature-dependent variable voltage generator 43 are the same as those of the circuit of the first embodiment. Resistor R1 is connected in parallel with PMOS transistor P4 between an output terminal O1 and a second input terminal I2 of the differential amplifier 41, thereby limiting the maximum impedance of the R1-P4 combination.

Figure 7:
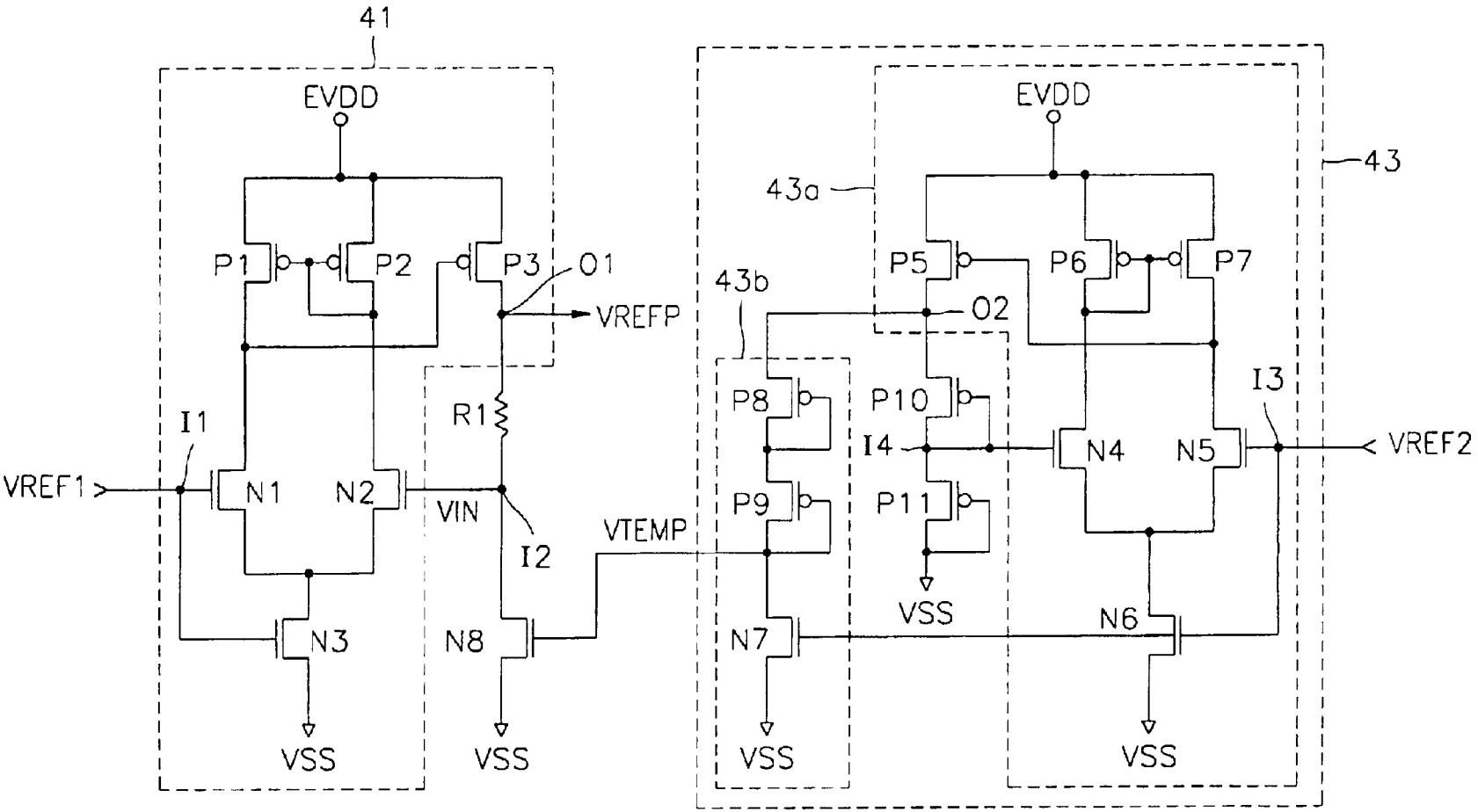
FIG. 7 illustrates a circuit diagram of an internal reference voltage generator according to a third embodiment of the present invention.

FIG. 7 illustrates an exemplary circuit diagram of an internal reference voltage generator according to a third embodiment of the present invention, which includes a differential amplifier 41, a resistor R1, an NMOS transistor N8 serving as a resistor, and a temperature-dependent variable voltage generator 43. Differential amplifier 41 and temperature-dependent variable voltage generator 43 are the same as those of the circuit of the first embodiment shown in FIG. 4. Resistor R1 is connected between an output terminal O1 and a second input terminal I2 of the differential amplifier 41. The NMOS transistor N8 is connected between the second input terminal I2 of the differential amplifier 41 and a ground voltage VSS, and the variable output voltage VTEMP of temperature-dependent variable voltage generator 43 is applied to a gate of NMOS transistor N8. Temperature-dependent variable voltage generator 43 generates the variable output voltage VTEMP varied according to variation in temperature and varies an equivalent resistance of NMOS transistor N8 through the variable output voltage VTEMP.

Figure 8:
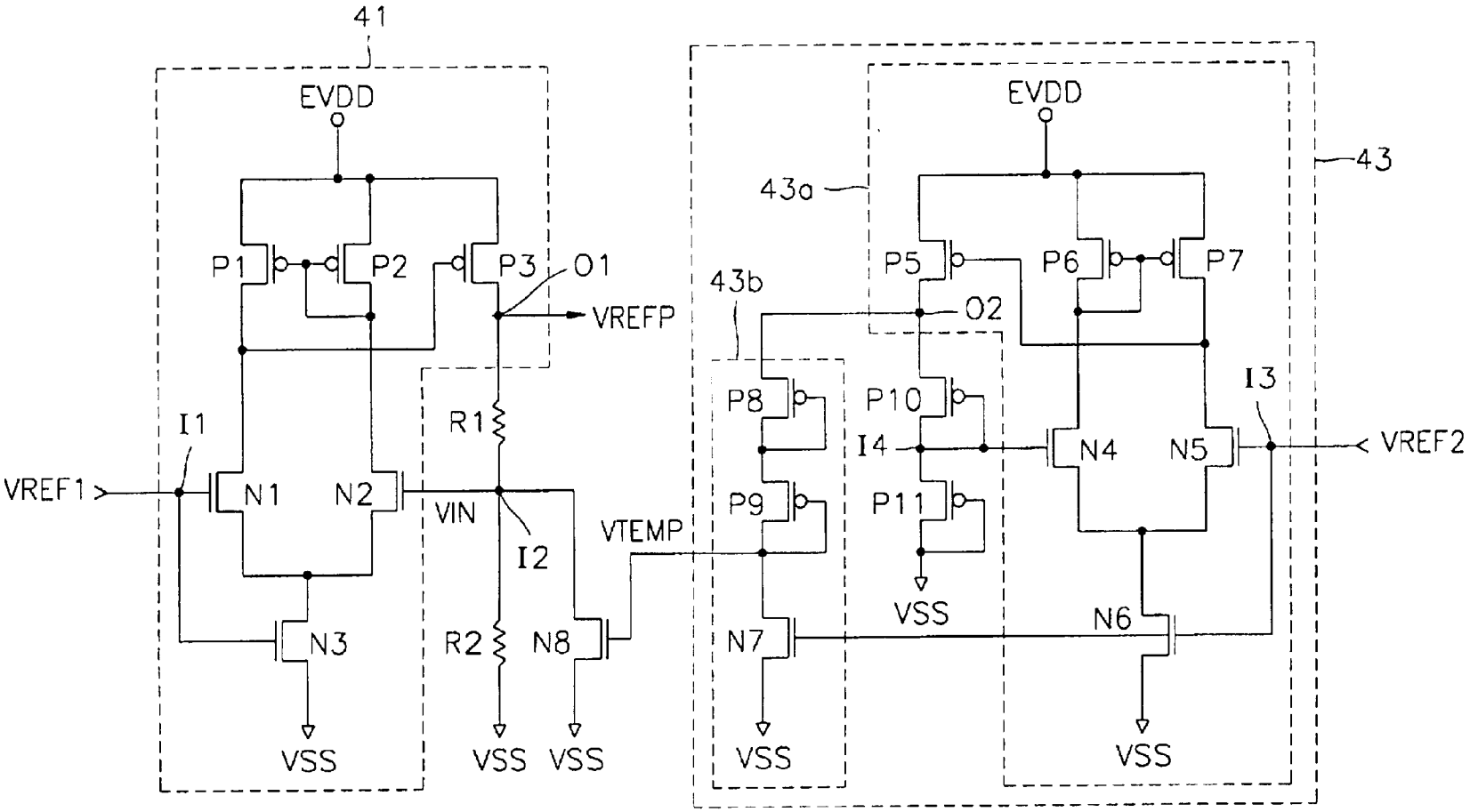
FIG. 8 illustrates a circuit diagram of an internal reference voltage generator according to a fourth embodiment of the present invention.

FIG. 8 illustrates an exemplary circuit diagram of an internal reference voltage generator according to a fourth embodiment of the present invention, which includes a differential amplifier 41, a resistor R1, an NMOS transistor N8 serving as a resistor, and a temperature-dependent variable voltage generator 43. The internal reference voltage generator according to the fourth embodiment of the present invention further includes a resistor R2, which is not present in the circuit of the third embodiment as shown in FIG. 7. Differential amplifier 41, resistor R1, NMOS transistor N8, and temperature-dependent variable voltage generator 43 are the same as those of the circuit of the third embodiment shown in FIG. 7. The resistor R2 is connected between a second input terminal I2 of the differential amplifier 41 and a ground voltage VSS.

Operation of the internal reference voltage generators according to the second through fourth embodiments is basically the same as the first embodiment, as shown in FIG. 4, and thus their detailed descriptions are omitted. The difference between the embodiments is in the particular resistive element for providing the variation in the output reference voltage.

Figure 9:
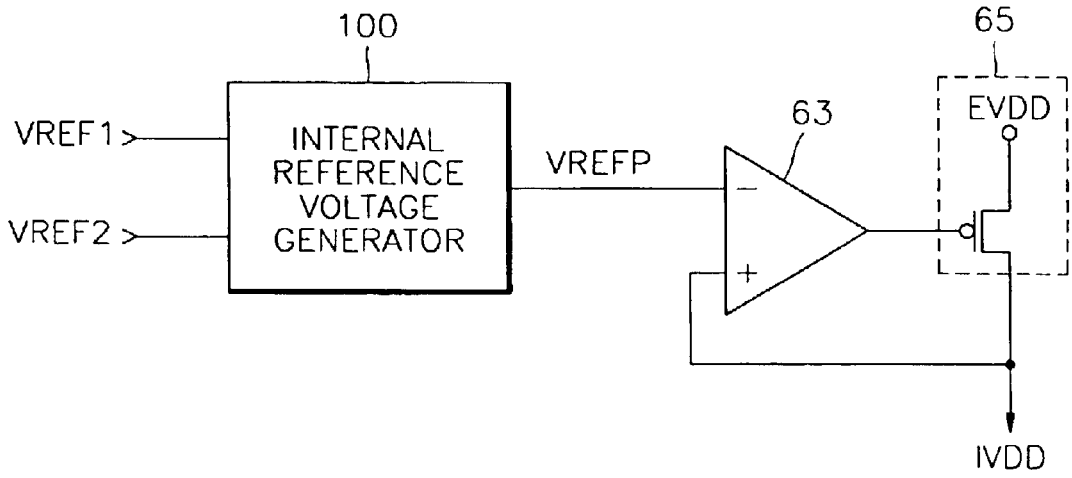
FIG. 9 illustrates a circuit diagram of an internal power supply voltage generator according to the present invention using an internal reference voltage generator according to the present invention.

FIG. 9 illustrates a circuit diagram of an internal power supply voltage generator according to the present invention using any one of the embodiments of the internal reference voltage generator according to the present invention. Referring to FIG. 9, the internal power supply voltage generator according to the present invention preferably includes an internal reference voltage generator 100, a comparator 63, and a driver 65. As previously discussed, the internal reference voltage generator of the internal power supply of FIG. 9 may be controlled by two separate reference voltages (VREF1 and VREF2) as shown in FIG. 9, or by a single reference voltage that is coupled to both input nodes of the internal reference voltage generator.

The internal reference voltage generator 100 is of one of the previously described internal reference voltage generators according to one of embodiments 1–4 of the present invention. The internal reference voltage generator 100 preferably increases an internal reference voltage VREFP as the temperature increases and decreases the internal reference voltage VREFP as the temperature decreases. The comparator 63 compares the internal reference voltage VREFP with an internal power supply voltage IVDD output from the driver 65. The driver 65 consists of a PMOS transistor, receives an external power supply voltage EVDD in response to an output signal of the comparator 63, and outputs the internal power supply voltage IVDD.

If the temperature increases, the internal reference voltage VREFP is increased, and the internal power supply voltage IVDD is increased. If the temperature decreases, the internal reference voltage VREFP is decreased, and the internal power supply voltage IVDD is decreased.

As described above, any one of the embodiments of the internal reference voltage generator and the internal power supply voltage generator according to the present invention is able to vary the value of the internal power supply voltage according to changes in temperature in order to reduce fluctuations in the performance of semiconductor devices. That is, the internal reference voltage generator and the internal power supply voltage generator are able to increase the value of the internal power supply voltage at a higher temperature, thereby increasing the current through transistor circuits. Further, the internal reference voltage generator and the internal power supply voltage generator may decrease the value of the internal power supply voltage at a lower temperature, thereby decreasing the current of the transistor circuits. Thus, the current in the transistor circuits may be maintained at a constant value regardless of variations in temperature. Accordingly, the internal reference voltage generator and the internal power supply generator according to the embodiments of the present invention may prevent semiconductor devices, and the performance thereof, from being sensitive to changes in temperature.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An internal reference voltage generator in a semiconductor device, comprising:

a temperature-compensating variable voltage generator for generating a temperature-compensated voltage;

a first differential amplifier for amplifying a voltage difference between a first reference voltage connectively coupled to a first input of the first differential amplifier and a first feedback voltage connectively coupled to a second input of the first differential amplifier in order to output an internal reference voltage;

a first voltage divider for generating and outputting the first feedback voltage in response to the temperature-compensated voltage, the first voltage divider further including:

a first resistive element connectively coupled between an output terminal and the second input terminal of the first differential amplifier; and a second resistive element connectively coupled between the second input terminal of the first differential amplifier and a second reference voltage; and wherein the first feedback voltage is dependent on the magnitude of the temperature-compensated voltage.

2. The internal reference voltage generator as claimed in claim 1, wherein an impedance of the first resistive element is dynamically varied.

3. The internal reference voltage generator as claimed in claim 1, wherein the first resistive element comprises a transistor; and a control terminal of the transistor is connectively coupled to the temperature-compensated voltage.

4. The internal reference voltage generator as claimed in claim 1, wherein the impedance of the second resistive element is dynamically varied.

5. The internal reference voltage generator as claimed in claim 1, wherein the second resistive element comprises a transistor; and a control terminal of the transistor is connectively coupled to the temperature-compensated voltage.

6. The internal reference voltage generator as claimed in claim 1, wherein the temperature-compensating variable voltage generator further includes:

a second differential amplifier for amplifying a voltage difference between a third reference voltage connectively coupled to a first input terminal of the second differential amplifier and a second feedback voltage connectively coupled to a second input terminal of the second differential amplifier in order to output an output voltage;

a second voltage divider for generating the second feedback voltage, further including:

a third resistive element connectively coupled between an output terminal of the second differential amplifier and the second input terminal of the second differential amplifier;

a fourth resistive element connectively coupled between the second input terminal of the second differential amplifier and the second reference voltage; and a variable voltage generator for generating the temperature-compensated voltage from the output voltage of the second differential amplifier.

7. The internal reference voltage generator as claimed in claim 6, wherein the third reference voltage is equal to the first reference voltage.

8. The internal reference voltage generator as claimed in claim 6, wherein the second reference voltage is a ground voltage.

9. The internal reference voltage generator as claimed in claim 6, wherein the third and fourth resistive elements comprise transistors.

10. The internal reference voltage generator as claimed in claim 6, wherein the temperature-compensating variable voltage generator comprises:

a first transistor, the output voltage being applied to a first terminal of the first transistor, and a gate of the first transistor being connected to a second terminal of the first transistor;

a second transistor, a first terminal of the second transistor being connected to a second terminal of the first transistor, and a second terminal and a gate of the second transistor both being connected to an output node to which the temperature-compensated voltage is output; and a third transistor, a first terminal of the third transistor being connected to the output node, the third reference voltage being applied to a gate of the third transistor, and the second reference voltage being applied to a source of the third transistor.

11. The internal reference voltage generator as claimed in claim 10, wherein the first and second transistors are PMOS transistors and the third transistor is an NMOS transistor and the first and second transistors operate in a weak inversion region.

12. The internal reference voltage generator as claimed in claim 10, wherein the first and second transistors are NMOS transistors and the third transistor is an NMOS transistor and the first and second transistors operate in a strong inversion region.

13. A temperature compensating reference voltage generator, comprising a temperature-compensating voltage divider for dividing an input reference voltage in order to generate a temperature-compensated output voltage at an output node of the voltage divider, wherein the temperature-compensating voltage divider includes:

at least a first electronic element having a first output impedance that exhibits a positive temperature coefficient; and at least a second electronic element having a second output impedance that exhibits a negative temperature coefficient;

the first and second electronic elements being combined such that a change in the temperature-compensated output voltage is a function of a change in temperature.

14. The temperature compensating reference voltage generator as claimed in claim 13, wherein the first electronic element is a PMOS transistor and the second electronic element is an NMOS transistor.

15. The temperature compensating reference voltage generator as claimed in claim 14, wherein the PMOS transistor operates in a weak inversion region and the NMOS transistor operates in a strong inversion region.

16. The temperature compensating reference voltage generator as claimed in claim 13, wherein the change in the temperature compensated output voltage is directly proportional to a change in temperature.

17. The temperature compensating reference voltage generator as claimed in claim 13, wherein the change in the temperature compensated output voltage is inversely proportional to a change in temperature.

18. A temperature compensating power supply, comprising:

a temperature-compensated reference voltage, which is generated from at least two reference voltages, at least one of which is a second temperature-compensated reference voltage generated by using at least one transistor operating in a weak inversion region and at least one transistor operating in a strong inversion region; and a regulating element for generating an output voltage from an input voltage under control of the temperature-compensated reference voltage, whereby the output voltage rises with increased temperature and falls with decreased temperature.

19. The temperature compensating power supply as claimed in claim 18, wherein the two reference voltages are about the same or the same.

20. A temperature compensating power supply, comprising:

a temperature-compensated reference voltage, which is generated from at least two reference voltages, at least one of which is a second temperature-compensated reference voltage generated by using at least one transistor operating in a weak inversion region and at least one transistor operating in a strong inversion region; and a regulating element for generating an output voltage from an input voltage under control of the temperature-compensated reference voltage, whereby the output voltage falls with increased temperature and rises with decreased temperature.

21. The temperature compensating power supply as claimed in claim 20, wherein the two reverence voltages are about the same or the same.

* * * * *